US006587664B1

(12) United States Patent
Baughman et al.

(10) Patent No.: US 6,587,664 B1
(45) Date of Patent: Jul. 1, 2003

(54) FUSER LOADING SYSTEM

(75) Inventors: Richard C. Baughman, Rochester, NY (US); James D. Shifley, Spencerport, NY (US); Terry N. Morganti, Brockport, NY (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/580,185

(22) Filed: May 26, 2000

(51) Int. Cl.[7] ..... G03G 15/20
(52) U.S. Cl. ..... 399/331; 399/328
(58) Field of Search ..... 399/67, 68, 320, 399/322, 328, 331, 339

(56) References Cited

U.S. PATENT DOCUMENTS 4,598,990 A * 7/1986 Kusumoto et al. ..... 399/339 X
5,315,359 A * 5/1994 Nishikawa ..... 399/328 X
5,572,307 A * 11/1996 Tomatsu et al. ..... 339/331 X
5,842,100 A * 11/1998 Yanashima et al. ..... 399/328

FOREIGN PATENT DOCUMENTS

JP 07-092847 * 4/1995

* cited by examiner

*Primary Examiner*—Sandra Brase

(57) ABSTRACT

A mechanism for applying pressure load force in a reproduction apparatus fuser device having at least one heated fuser member and a pressure member in nip relation to permanently fix a marking particle image to a receiver member. The pressure load force applying mechanism includes a load arm assembly rotatable about a fixed pivot axis to apply a pressure force to the pressure member, and a load cam selectively rotated about a drive shaft. A cam follower member is associated with the load cam, wherein a force of the load cam is applied via the cam follower member to the load arm assembly. A spring nest is formed as a part of the load arm assembly. The spring nest supports at least a heavy spring and a light spring; wherein the cam follower member, upon movement under the influence of the load cam, compresses the nested light spring and the heavy spring at different travel positions of the cam follower for varying the pressure force on the pressure member.

6 Claims, 2 Drawing Sheets

FUSER LOADING SYSTEM

CROSS-REFERENCE TO RELATED APPLICATION

Reference is made to the commonly assigned U.S. Patent Application, the respective disclosures of which being incorporated herein by reference:

U.S. patent application Ser. No. 09/579,550, filed on May 26, 2000, entitled "CAM CONTROL MECHANISM".

FIELD OF THE INVENTION

This invention relates in general to fuser for a reproduction apparatus, and more particularly to a mechanism for pressure loading of a reproduction apparatus fuser.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of fuser device for typical electrographic reproduction apparatus includes at least one heated roller, having an aluminum core and an elastomeric cover layer, and at least one pressure roller in nip relation with the heated roller. The fuser device rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member. In applying pressure to the fusing nip, the pressure must be held within a desired tolerance range in order to achieve adequate fusing without disrupting transport of the receiver member through the fuser device and without damaging the receiver member or the fuser device. Prior fuser devices have had difficulties in balancing these at-opposite requirements.

SUMMARY OF THE INVENTION

In view of the above, this invention is directed to a mechanism for applying pressure load force in a reproduction apparatus fuser device having at least one heated fuser member and a pressure member in nip relation to permanently fix a marking particle image to a receiver member. The pressure load force applying mechanism includes a load arm assembly rotatable about a fixed pivot axis to apply a pressure force to the pressure member, and a load cam selectively rotated about a drive shaft. A cam follower member is associated with the load cam, wherein a force of the load cam is applied via the cam follower member to the load arm assembly. A spring nest is formed as a part of the load arm assembly. The spring nest supports at least a heavy spring and a light spring; wherein the cam follower member, upon movement under the influence of the load cam, compresses the nested light spring and the heavy spring at different travel positions of the cam follower for varying the pressure force on the pressure member.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
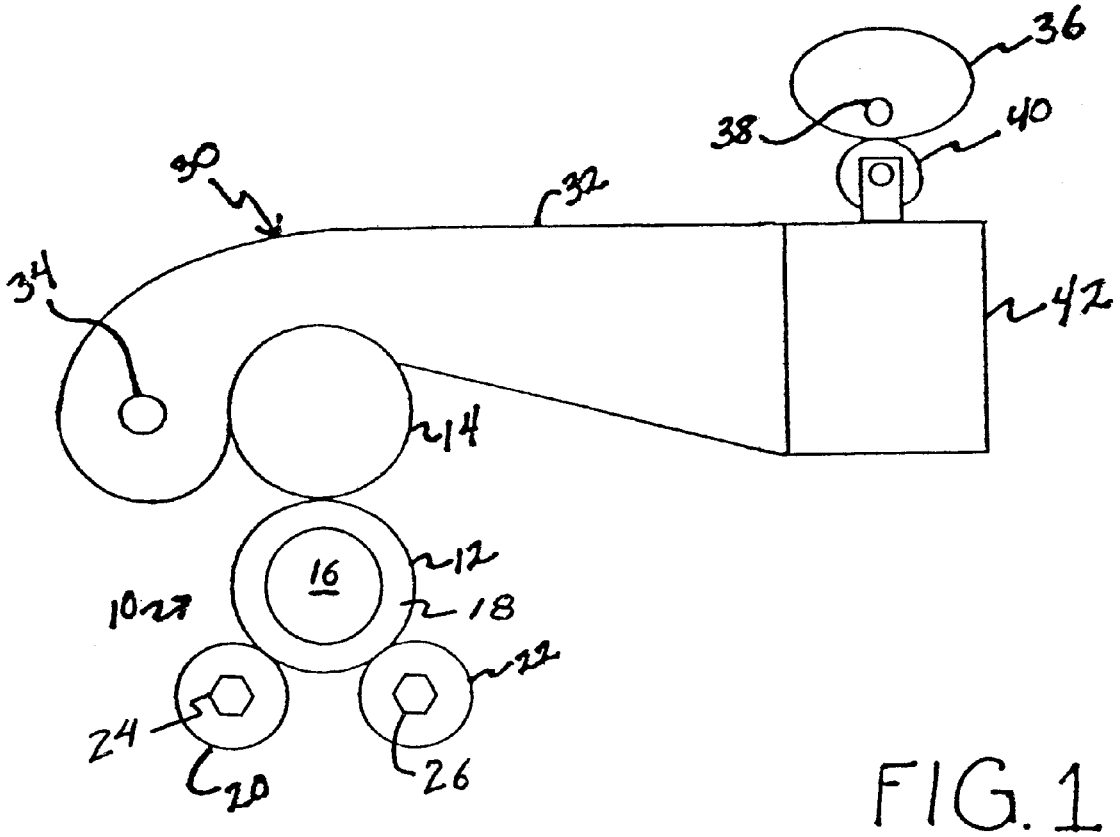
FIG. 1 is a generally schematic side elevational view of a reproduction apparatus fuser assembly and the pressure loading mechanism for the fuser assembly according to this invention.

Referring now to the accompanying drawings, FIG. 1 shows, generally schematically, a fuser device 10 having a pressure loading mechanism, according to this invention, designated generally by the numeral 30. The fuser device 10 includes an elongated heated fuser roller 12 in nip relation with a pressure roller 14. Rotation of the fuser rollers by any suitable drive mechanism (not shown) will serve to transport a receiver member (designated by the letter R), bearing a marking particle image through the nip in the indicated direction under the application of heat and pressure. The receiver member may be, for example, a sheet of plain bond receiver member, or transparency material, and may be of any width, for example between 8" to over 14". The heat will soften the marking particles and the pressure will force the particles into intimate contact to be at least partially imbibed into the fibers at the surface of the receiver material. Thus, when the marking particles cool, they are permanently fixed to the receiver member in an image-wise fashion.

The elongated fuser roller 12 includes a core 16, for example made of aluminum, and a cylindrical fusing blanket 18 supported on the core. The blanket 18 is typically made of a elastomeric material such as rubber particularly formulated to be heat conductive or heat insulative dependent upon whether the fuser heat source is located within the core 16 or in juxtaposition with the periphery of the blanket. A well known suitable surface coating (not shown) may be applied to the blanket 18 to substantially prevent offsetting of the marking particle image to the fuser roller 12. In the illustrated preferred embodiment as shown in the FIG. 1, the heat source for the fuser roller 12 is a pair of external heater rollers, respectively designated by the numerals 20, 22, having internal heater lamps 24, 26. The fuser roller is cradled between the two heater rollers 20, 22, and heat is applied to the fuser roller from the internally heated heater rollers.

The pressure load on the elongated fuser roller 12 is applied by the pressure roller 14. The pressure roller 14 has a hard outer shell. Typically, the shell is made of metal, such as aluminum or steel for example. The shell may also have a well known suitable surface coating (not shown) applied thereto to substantially prevent offsetting of the marking particle image to the pressure roller 14. A cleaning assembly (not shown) may be provided to remove residual marking particle, receiver member fibers, and dust from the fuser apparatus rollers.

As discussed above, the fixing of marking particles to receiver member requires heat and pressure. According to this invention, the pressure load force applying mechanism 30 includes a load arm assembly 32 which is rotatable about a fixed pivot axis 34 to apply a downward force to the pressure roller 14. (In detail, this force is actually applied to the bearing ends of the pressure roller.) The rotational movement of the load arm assembly 32 about the pivot axis 34 is created by rotation of a load cam 36. The load cam 36 is rotated about a drive shaft 38 by any suitable motor (not shown) controlled for selective operation by the reproduction apparatus micro-processor based logic and control unit.

The downward force of the load cam 36 is applied via a cam follower member 40, through an elongated shaft 50 attached to the cam follower, to the load arm assembly 32. The load arm assembly 32 has a spring nest 42 formed as an integral part of the load arm assembly adjacent to one end thereof. A load plate 44 forms the floor of the spring nest and is located in juxtaposition with the lower portion of the load arm assembly 32. The load plate 44, which forms a guide for the shaft 50 as the shaft moves in a longitudinal direction under the influence of the load cam 40, supports a heavy spring 46 and a light spring 48. The springs 46 and 48 are helical compression springs, concentrically supported on the load plate 44 to surround the elongated shaft 50. The shaft 50 of the cam follower 40 additionally supports a light spring piston 52 and a shoulder feature 54. The light spring piston 52 engages (and acts on) the light spring 48, and the shoulder feature 54 is adapted to selectively contact (and acts on) a heavy spring piston 56 retained in the spring nest 42.

Figure 2:
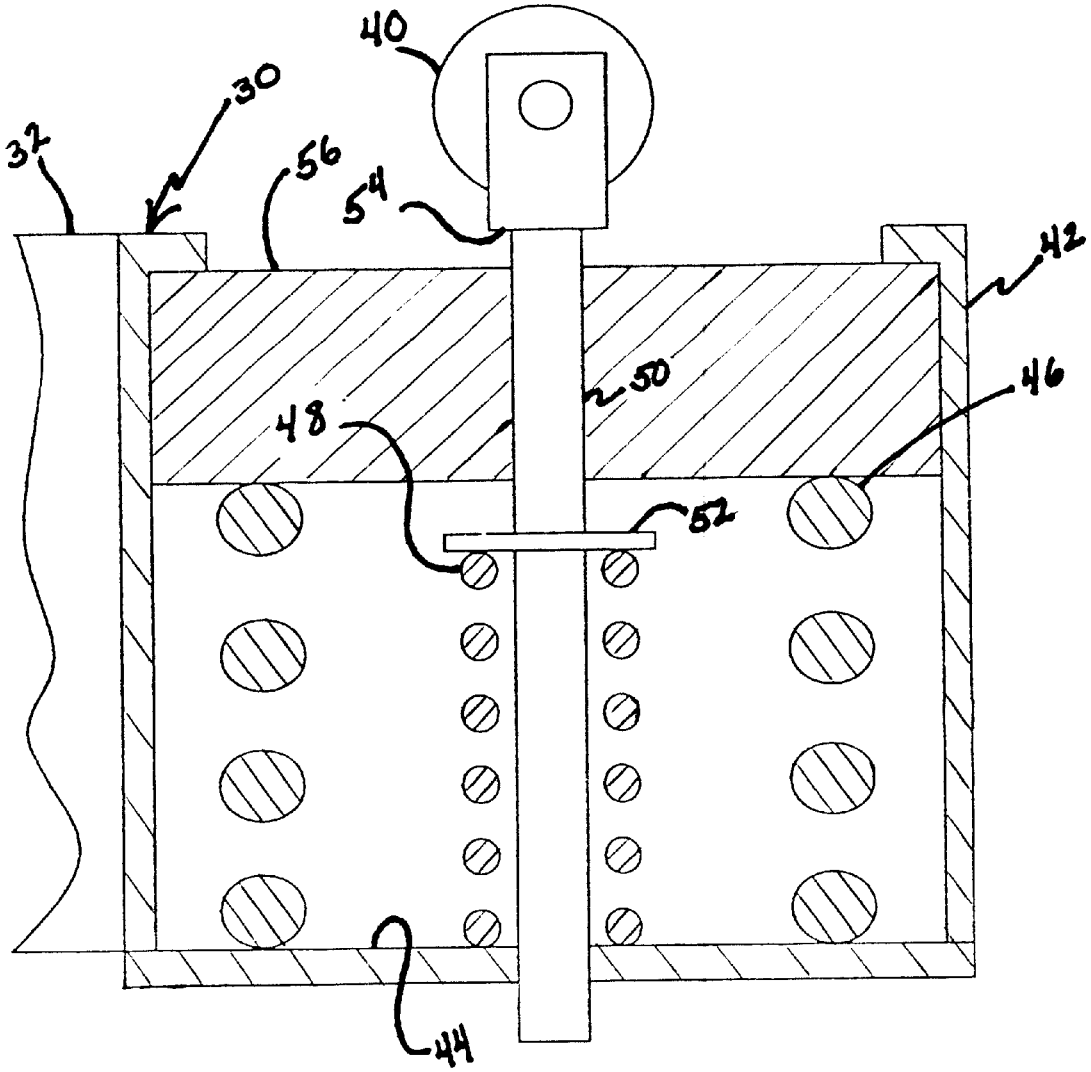
FIG. 2 is a generally schematic side elevational view, partly in cross-section and on an enlarged scale, of the pressure loading mechanism of FIG. 1.

The cam follower 40, upon movement under the influence of the load cam 36, compresses the nested springs 46, 48 at different longitudinal travel positions. In the position shown in FIG. 2, only the light spring 48 has been somewhat compressed (by the light piston spring 52), and the load applied to the arm assembly 32 is only dependent upon the spring constant of the light spring 48. Upon further downward travel of the cam follower 40, the shoulder 54 engages the heavy spring piston 56 and compresses the heavy spring 46. The load plate 44 would then be acted upon by both the light spring 48 and the heavy spring 46, and the load applied to the arm assembly 32 is dependent upon the spring constant of the light spring and the heavy spring.

With the described loading of the load arm assembly 32, depending upon the desired fuser nip loads, springs of varying spring constants and load can be easily changed and installed by simply removing the load plate 44 and substituting springs. Similarly, piston dimensions, locations and cam travel is easily changed to further vary fuser nip forces. This interchangeability of numerous components associated with the load arm assembly 32 accommodates a wide range of fuser/pressure roller materials and diameters to be incorporated. Moreover, the lever arm advantage (due to location of the pressure load forces applied to the pressure roller 14 relative to the location of the load plate 44) permits the usage of smaller, less costly springs. By engaging the light spring 48 only, controlled by the rotary position of the cam 36, much less nip force between the pressure roller 14 and the fuser roller 12 is provided during the time when copying is not in process, specifically during periods of idle time. Normally the time when copying is not in process, the fuser roller is rotating at some reduced speed in order to keep warm and ready. Operating in the idle mode at reduced nip loads, according to this invention, reduces roller wear and greatly extends roller life.

During the reproduction process, when generally much higher nip forces are required, the cam 36 is positioned to cause the cam follower 40 to engage the high, and low, force springs to create sufficient nip pressure. In the event of a copying stoppage (jam, etc.), software control of the load cam 36 can provide for positioning of the cam follower to a minimal or no load position which removes the nip load for easy removal of any receiver member located between the pressure and fuser roller nip. After a stoppage or during warm up, the load cam 36 can be engaged for high nip load forces which has been found to expedite heating of the fuser roller.

The invention has been described in detail with particular reference to certain preferred embodiments thereof, but it will be understood that variations and modifications can be effected within the spirit and scope of the invention.

What is claimed is:

1. A mechanism for applying pressure load force in a reproduction apparatus fuser device having at least one heated fuser member and a pressure member in nip relation to permanently fix a marking particle image to a receiver member, said pressure load force applying mechanism comprising:

a load arm assembly rotatable about a fixed pivot axis to apply a pressure force to said pressure member;

a load cam selectively rotated about a drive shaft;

a cam follower member, associated with said load cam, wherein a force of said load cam is applied via said cam follower member to said load arm assembly; and a spring nest formed as a part of said load arm assembly, said spring nest supporting at least a heavy spring and a light spring, wherein said cam follower member, upon movement under the influence of said load cam, compresses said nested light spring and said heavy spring at different travel positions of said cam follower for varying the pressure force on said pressure member.

2. The pressure load force applying mechanism according to claim 1 wherein said spring nest is formed as part of said load arm assembly adjacent to one end thereof.

3. The pressure load force applying mechanism according to claim 2 wherein said spring nest includes a load plate forming a floor of said spring nest, said load plate being located in juxtaposition with the lower portion of said load arm assembly.

4. The pressure load force applying mechanism according to claim 3 wherein said at least heavy spring and light spring include a heavy and a light helical compression spring, concentrically supported on said load plate.

5. The pressure load force applying mechanism according to claim 4 wherein said cam follower includes an elongated shaft, and wherein said load plate forms a guide for said elongated shaft as said shaft moves in a longitudinal direction under the influence of said load cam.

6. The pressure load force applying mechanism according to claim 5 wherein said elongated shaft includes a light spring piston and a shoulder feature, said light spring piston engaging and acting on said light spring, and said shoulder feature being adapted to selectively contact and act on a heavy spring piston retained in said spring nest.

* * * * *